US005600088A

United States Patent [19]

Oberth

[11] Patent Number: 5,600,088

[45] Date of Patent: Feb. 4, 1997

[54] COATINGS FOR SOLID PROPELLANTS

[75] Inventor: Adolph E. Oberth, Fair Oaks, Calif.

[73] Assignee: Aerojet General Corporation, Rancho Cordova, Calif.

[21] Appl. No.: 263,586

[22] Filed: Oct. 27, 1988

[51] Int. Cl.[6] ..... C06B 45/22

[52] U.S. Cl. ..... 149/11; 149/92; 149/109.6; 106/287.35; 264/3.4

[58] Field of Search ..... 149/109.6, 92, 149/11; 106/400, 287.35; 252/182.12; 264/3.4

[56] References Cited

U.S. PATENT DOCUMENTS 4,098,627 7/1978 Tompa ..... 149/92
4,165,247 8/1979 Brew et al. ..... 149/19.4
4,427,466 1/1984 Flanagan et al. ..... 149/92
4,450,110 5/1984 Simmons et al. ..... 149/92
4,761,250 8/1988 Frankel et al. ..... 149/92

OTHER PUBLICATIONS

Trident 1 C4 Third–Stage Propellant Development (U). Final Report. Report C4–EDP–P–F. Nov. 1, 1972. Aerojet Solid Propulsion Company. pp. 1–6.

*Primary Examiner*—Donald P. Walsh
*Assistant Examiner*—Anthony R. Walston
*Attorney, Agent, or Firm*—Townsend & Townsend and Crew

[57] ABSTRACT

This invention relates to improved polyurea coating compositions for particluate solids, and especially for fillers which are useful in solid rocket propellants. The composition is a copolymer of a primary or secondary amine and 3-nitrazapentane diisocyanate.

33 Claims, 1 Drawing Sheet

COATINGS FOR SOLID PROPELLANTS

BACKGROUND OF THE INVENTION

This invention relates to improved coating materials for particulate solids, and especially for fillers which are useful in solid rocket propellants. More particularly, it relates to coating materials which are neutral and which enhance the bond between the powdered solids and binder material which are propellant components.

When a propellant is subjected to mechanical stress, failure of the matrix will occur when the stresses in the binder phase reach a magnitude comparable to the elastic modulus of the unfilled matrix. Owing to stress concentrations, the matrix in the immediate vicinity of the filler particles will be the first to fail, causing the formation of tiny voids. If the load on the specimen is increased further, eventually a state is reached where the thin membrane of the matrix separating the particle from the void breaks, causing a sudden and complete withdrawal of the matrix from the solid. This situation is usually referred to as dewetting or blanching. In a "dewetted" propellant, the filler has lost its reinforcing effect, and a structurally very weak material results in which the entire load is borne by the matrix. It is well known that propellants which dewet have poor strain cycling ability.

If the filler particle is attached to the matrix by primary chemical bonds (e.g. an epoxy resin in a polyurethane binder), dewetting does not occur and, therefore, the filler does not lose its reinforcement. Consequently, the composite will reach higher stresses and elongations before failure. Fillers which per se do not contain functional groups to form this linkage to the binder can be converted to reinforcing fillers by enveloping them with a shell of an appropriate material.

It was previously believed that an effective coating required residual amino or OH groups in order to form the required primary bond with the matrix (e.g. a polyurethane binder). Therefore, the early coatings were usually either polyurethanes or reaction products of amines with epoxides. To produce such coatings on particles is relatively cumbersome due to the long reaction times required. Furthermore, in the case of epoxy-amine coatings, the basic nitrogen remaining can impose serious problems with some other propellant ingredients. Particularly for the intended purpose of these coatings, basicity is not tolerable since it is imcompatible with most high energy plasticizers, which are an important part of certain high energy, high impulse solid rocket propellants. Additionally, the catalyst triphenylbismuth (TPB), which is used in virtually all nitro- or nitratoester plasticized high energy propellants, does not function in the presence of basic impurities.

To overcome the problem, certain polyurea coatings were developed. However, these coatings were only partially successful; while the reaction between the amine and an isocyanate was practically instantaneous, the resulting compound still contained basic impurities. For example, a tetraethylenepentamine/acrylonitrile coating was developed that gave a significant improvement of the mechanical properties of bis(fluorodinitroethylformal) ("FEFO") plasticized polyethylene glycol propellants. Although the coating contained considerable basic impurities, basicity was not a problem with such propellants because of the extreme base sensitivity of FEFO, which immediately neutralizes basic impurities, albeit with decomposition. However, such "self-neutralization" is absent in nitrate ester systems, so that when the coating was used with nitroglycerin ("NG") plasticized propellants, cure interference was encountered. Accordingly, such coatings could not be used for nitrate-plasticized propellants.

Therefore, the problem remained to develop a coating that reacted quickly to coat powdered propellant solids while eliminating basic impurities.

SUMMARY OF THE INVENTION

A unique improved polyurea coating composition has now been discovered, which is neutral and is thus successfully reactive with nitro- and nitratoester plasticized propellants, giving significant improvement of the mechanical properties of such propellants. The composition is a copolymer of a primary or secondary amine and 3-nitrazapentane diisocyanate. Such coating is generally useful as a coating for other particulate solids as well.

DETAILED DESCRIPTION OF THE INVENTION

Figure 1:
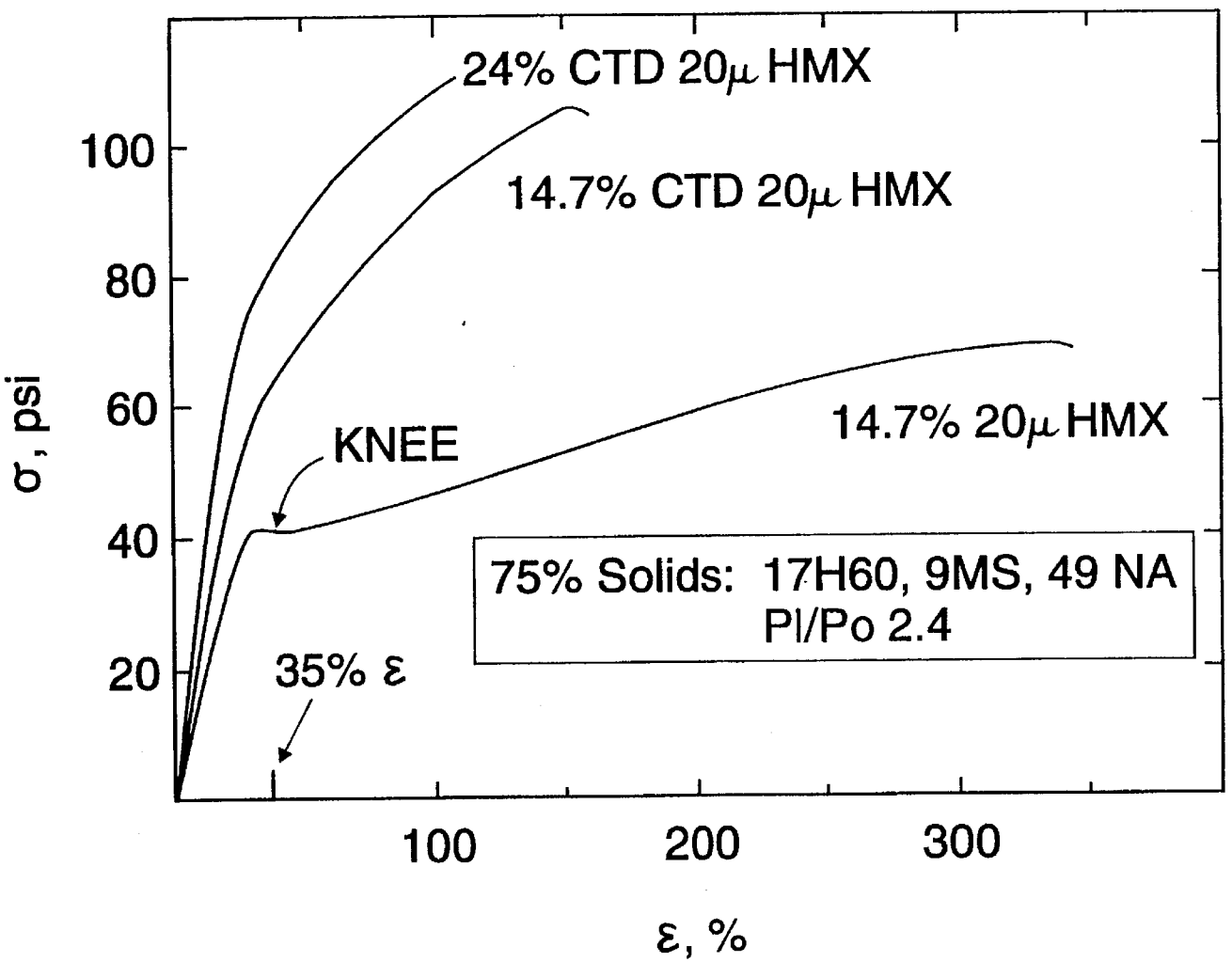
FIG. 1 illustrates the effect on stress-strain properties of coated versus uncoated particle fillers in a polymerized propellant.

According to the present invention, a primary or secondary polyfunctional amine and the isocyanate 3-nitrazapentane diisocyanate are combined together to give a polyurea coating for particulate solids. Such a copolymeric coating is particularly useful when used to coat solids which are used as fillers in solid propulsion propellants, especially nitro- and nitratoester plasticized propellants.

Materials coated according to the present invention are generally prepared as follows. The particulate solids to be coated are slurried in an inert non-solvent hydrocarbon medium, e.g. hexane or heptane, to give a fluid suspension. To this vigorously agitated suspension is slowly added a solution of the amine in a suitable non-aqueous solvent such as toluene, acetone or methylene chloride. After the addition of the amine is complete, the diisocyanate, which may optionally be in solution in a non-aqueous solvent, is slowly added. The coating process is essentially over when the diisocyanate addition is completed. The slurry is filtered and the coated solids are dried.

Additionally, dinitrosalicylic acid (DNSA) may be added following the addition of the diisocyanate. The DNSA is a neutralizing agent and thus provides an added safeguard against any isolated areas of basicity which may occur in the coating. It also is useful in indicating a uniform dispersion, as it imparts a yellow color to those areas where it is present.

The amine and the isocyanate are chosen to be insoluble in hydrocarbon media which are used to slurry the particulate solids to be coated, so that both will precipitate out of solution when added to the slurry, thus forming a copolymeric coating on the solids.

In a preferred embodiment of the invention, the amine is diethylenetriamine.

3-Nitrazapentane diisocyanate is used as the isocyanate of the invention since it appears to contribute to the elimination of residual basicity where other isocyanates do not.

The molar ratio of amine to diisocyanate is from about 1:1 to about 1:2, preferably from about 1:1 to about 1: 1.5, more preferably from about 1:1 to about 1.2.

The relative proportion of polyurea coating composition to particulate solids is from about 0.2% to about 2.0%, by weight. The ratio is partially dependent on the particle size of the solid. For example, 20 m particles are preferably coated with about 0.5% by weight of coating material whereas 2 m particles may require up to about 2% by weight of coating material.

Any particulate solid may be coated by the materials and processes of the present invention. In a preferred embodiment, the invention is of particular utility when used with those solids which are useful as filler particles, particularly for solid propulsion propellants. Examples of such filler particulate solids are, e.g., triaminoguanidine (Tag) nitrate, ammonium nitrate, ammonium perchlorate, nitremines such as cyclotetramethylene tetranitramine (HMX) and cyclo-1, 3,5-trimethylene-2,4,6-trinitramine (RDX), and metallic powders such as aluminum.

The filler particles are included as part of a propellant system which comprises, in addition, an explosive component and a binder or binder composition.

The filler solids in the propellant system may include a mixture of coated and uncoated particles. The relative proportion of coated solids of the present invention in the system may range from about 10% to about 75%, preferably from about 12% to about 50% by weight of the total system.

The binder or binder composition is comprised of any liquid capable of curing to a solid form, optionally including further ingredients known for use with binders such as, for example, catalysts and stabilizers. The binder is included in a sufficient amount to render the uncured composition pourable so that it can be pour-cast.

Examples of binder materials useful in the propellant system include polybutadienes, both carboxy- and hydroxy-terminated, polyethylene glycol, polyethers, polyesters (particularly hydroxy-terminated), polyfluorocarbons, epoxides, and silicone rubbers (particularly two-part).

Such binder material defines a matrix that joins the energetic powdered propellant solids into a monolithic solid propellant grain. The coating materials and coated filler solids of the invention enhance and improve the bond between the solids and the binder material and give improved mechanical properties to the propellants.

The following abbreviations are used in the examples herein:

"HMX" is cyclotetramethylene tetranitramine, which is a solid filler.

"RDX" is cyclo-1,3,5-trimethylene-2,4,6-trinitramine, a solid filler.

"DETA" is diethylenetriamine.

"TEPA" is tetraethylenepentamine.

"XIII" is 3-nitrazapentane diisocyanate.

"HDI" is hexamethylene diisocyanate.

"N100" is biuret triisocyanate (commercially available from Mobay Chemicals).

"GBCA" is glycerol-bis-chloroacetate, a quaternizing agent.

"$RBr_2$" is dibromohexane, a quaternizing agent.

"BAMO/NMMO" is bis(azidomethyloxetane)/nitratomethylmethyloxetane, a prepolymer.

"$s_m$, psi" is the tensile strength of a solid propellant.

"$e_m$, %" is the elongation of a solid propellant.

"$E_o$, psi" is the modulus of a solid propellant.

"$s_{35\%\ e}$" is the stress at 35% strain of a solid propellant.

The following examples are offered for illustrative purposes only, and are intended neither to define nor limit the invention in any manner.

EXAMPLE 1

Powdered 20 m HMX particles (500 g) are suspended in hexane (1.5 L). Diethylenetriamine (DETA; 0.7 g) is dissolved in methylene chloride (15 mL) just prior to addition and is then added slowly to the stirred fluid suspension of HMX. After addition of the DETA is complete, a solution of 3-nitrazapentane diisocyanate (XIII; 4.0 g) in methylene chloride (15 mL) is slowly added. The reaction is essentially complete immediately following addition of the XIII. The pH of the DETA/XIII-coated HMX particles is 6–7.

In the same manner as above, HMX is coated with DETA/N100, with DETA/HDI, or with TEPA and one of the three isocyanates XIII, N100 and HDI, and the pH's of the resulting coated particles is measured. Additionally, TEPA/HDI with added quaternizing agents are prepared. The pH's are given in Table A below. As shown in the Table, the TEPA/isocyanate copolymers were all basic, as was DETA copolymerized with either N100 or HDI isocyanate. Addition of a quaternizing agent such as GBCA or $RBr_2$ gives a slightly more neutral pH. However, the DETA/XIII copolymer gives a pH most close to neutral.

TABLE A

HMX Coating Studies in Hexane

| Amine | Isocyanate | pH of Coating |
|---|---|---|
| TEPA | N100 | >8 |
| TEPA | HDI | >8 |
| TEPA | XIII | >8 |
| TEPA/GBCA | HDI | ?8 |
| TEPA/$RBr_2$ | HDI | ?8 |
| DETA | N100 | >8 |
| DETA | HDI | >8 |
| DETA | XIII | 6–7 |

EXAMPLE 2

Following the procedure of Example 1, 50 m HMX particles (500 g) suspended in 1.0 L of hexane are stirred together with DETA (0.7 g) in 15 mL of methylene chloride and then with XIII (4.0 g) in 15 mL of methylene chloride. The coated particles are then dried.

In the same general manner, DETA/XIII-coated HMX particles of 2 micron size are prepared.

EXAMPLE 3

HMX nitramine particles, coated and/or uncoated, are mixed with each of two powdered nitroglycerin-plasticized polyethylene glycol (PEG/NG) propellant formulations in. Each resulting polymerized PEG/NG formulation contains 75% solids consisting of 17% aluminum H60, 9% ammonium perchlorate (AP; 90 micron) and 4.9% nitramine (HMX). One group of the formulations has a plasticizer-to-polymer ratio (Pl/Po) of 2.17 and also contains 2% nitrocellulose (NC). The second group has a Pl/Po of 3.17 and has no NC. After mixing is complete, the mixture is cured at 135° F. (57° C.) using TPB catalyst.

All of the resulting polymerized propellants cured within two days with no evidence of cure interference.

The mechanical properties of the prepared propellants are presented in Tables B and C below. In all cases, superior properties were obtained when coated HMX particles were included in the system.

TABLE B

Mechanical Properties (at 77° F.) of Propellants Using DETA/XIII-Coated HMX

| Nitramine, % | | | | | | |
|---|---|---|---|---|---|---|
| 2 m | 20 m | 50 m | $s_m$, psi | $e_m$, % | $E_o$, psi | $s_{35\%}$ e |
| | | | Pl/Po 2.17, 0.2% NC | | | |
| 24U* | 25U | — | 63 | 226 | 409 | 39 |
| 24U | 25C | — | 106 | 108 | 602 | 84 |
| 24U | — | 25C | 112 | 96 | 571 | 75 |
| 34U | 15C | — | 102 | 132 | 570 | 65 |
| 15C | 34C | — | 131 | 30 | 880 | — |
| 24C | 25C | — | 185 | 35 | 950 | 185 |
| 24C | 25U | — | 95 | 17 | 800 | — |
| | | | Pl/Po 3.17, no NC | | | |
| 24U | — | 25C | 75 | 108 | 321 | |
| 24C | — | 25C | 138 | 45 | 673 | |
| 15C | 34C | — | 115 | 34 | 602 | |
| 24C | 25C | — | 127 | 42 | 585 | |

*C = coated
U = uncoated

TABLE C

Mechanical Properties ($s_m$, psi; $e_m$, %; $s_o$, psi) Of Propellants (Pl/Po 3.17, no NC) Over Temperature Range

| Nitramine | | | | | | | | | | | | |
|---|---|---|---|---|---|---|---|---|---|---|---|---|
| 2 u | 20 u | 140° F. | | | 77° F. | | | 0° F. | | | −40° F. | |
| 15C | 34C* | 97 | 27 | 519 | 115 | 34 | 602 | 177 | 43/57 | 905 | 355 | 46/67 | 224 |
| 24C | 25C | 102 | 38 | 524 | 127 | 42 | 585 | 207 | 46/50 | 930 | 323 | 40/45 | 240 |

*C = coated

EXAMPLE 4

Following the procedures of Example 1 or 2, polymerized PEG/NG propellants are prepared with a Pl/Po of 2.4 and containing 75% solids, of which 17% is aluminum H60, 9% is ammonium perchlorate and 49% is HMX nitramine. One sample of the propellant contains 14.7% uncoated 20 m HMX, a second sample contains 14.7% DETA/XIII-coated 20 m HMX, and a third contains 24% DETA/XIII-coated 20 m HMX. The stress-strain properties of the resulting polymerized samples are measured by an Instron tensile tester.

The effect of the uncoated versus the coated HMX on the stress-strain properties is illustrated in FIG. 1. As little as 15% coated (CTD) 20 m particles of HMX eliminates the "knee", which many structural analysts consider the limit of useful strain of PEG/NG propellants.

EXAMPLE 5

Following the general procedure of Example 1 or 2, DETA/XIII-coated or uncoated particles of HMX are mixed with one of two powdered nitroglycerin plasticized BAMO/NMMO high energy propellants. One propellant formulation comprises 70% total solids consisting of 18% aluminum, 16% $NH_4NO_3$ and 36% HMX nitramine (formulation "A"). The second propellant formulation comprises 70% total solids consisting of 55% $NH_4NO_3$ and 15% HMX nitramine (formulation "B").

The mechanical properties of the resulting polymerized propellants are presented in Table D below. Because of the relatively high molecular weight and high effective plasticizer-to-polymer ratio in the BAMO/NMMO systems, it is difficult to increase propellant modulus ($E_o$, psi) to an acceptable value The use of HMX precoated with DETA/XIII accomplishes this and, simultaneously, greatly improves propellant tensile strength ($s_m$, psi).

TABLE D

Mechanical Properties (at 77° F.) of Propellants Using DETA/XIII-Coated HMX

| Nitramine, % | | | | |
|---|---|---|---|---|
| 2 m | 20 m | $s_m$, psi | $e_m$, % | $E_o$, psi |
| | | BAMO/NMMO "A" | | |
| 22U* | 14U | 42 | 120 | 84 |
| 22C | 14C | 93 | 50 | 250 |

TABLE D-continued

Mechanical Properties (at 77° F.) of Propellants Using DETA/XIII-Coated HMX

| Nitramine, % | | | | |
|---|---|---|---|---|
| 2 m | 20 m | $s_m$, psi | $e_m$, % | $E_o$, psi |
| | | BAMO/NMMO "B" | | |
| 15U | — | 64 | 90 | 92 |
| 15C | — | 112 | 66 | 211 |

*C = Coated
U = Uncoated

EXAMPLE 6

To study the effect of bonding agents on propellants with low solids content, BAMO/NMMO prepolymer propellants are mixed with the additive-type bonding agents nitrocellulose (NC) or cyanoethylated cellulose (CEC) or with DETA/XIII-coated HMX, or various combinations thereof, following the procedures of Example 5. The mechanical properties of the resulting polymerized propellants are presented in Table E below.

TABLE E

Effect of Additive-Type Bonding Agents And DETA/XII-Coated HMX on Mechanical Properties of BAMO/NMMO Propellants

| Bonding System | BAMO/NMMO* | m' psi | m' % | b' % | $E_o$, psi |
|---|---|---|---|---|---|
| NC (0.3%) | 90/10 | 47 | 221 | 225 | 26 |
| CEC (0.1%) | 90/10 | 39 | 224 | 245 | 21 |
| Coated 2 u HMX | 90/10 | 68 | 184 | 185 | 42 |
| None | 70/30 | 34 | 166 | 172 | 60 |
| NC (0.3%) | 70/30 | 43 | 164 | 170 | 73 |
| CEC (0.1%) | 70/30 | 35 | 187 | 191 | 67 |
| NC (0.2%) + CEC (0.1%) | 70/30 | 51 | 130 | 133 | 88 |
| Coated 2 u HMX | 70/30 | 71 | 126 | 129 | 92 |
| Coated 2 u HMX + NC (0.2%) | 70/30 | 75 | 139 | 144 | 85 |
| Coated 2 u HMX + CEC (0.1%) | 70/30 | 68 | 134 | 138 | 77 |
| Coated 2 u HMX + NC (0.2%) + CEC (0.1%) | 70/30 | 89 | 110 | 112 | 110 |

*BAMO/NMMO (90/10) prepolymer: 43.2% solids (18% Al H60, 12% HMX (2 u), 13.2% AP (28 u))
BAMO/NMMO (70/30) prepolymer: 54.1% solids (18% Al H60, 27% HMX (2 u), 9.1% AP (28 u))
Binder: Pl/Po = 2.0, NCO/OH = 1.6

EXAMPLE 7

Following the procedure of Example 1 or 2, DETA/XIII-coated RDX particles of 2 micron size are prepared and are then dried.

The coated RDX nitramine particles are mixed with a BAMO/NMMO prepolymer propellant formulation. The resulting polymerized formulation contains 70% solids consisting of 55% NiO-PSAN and 15% DETA/XIII-coated 2 m nitramine (RDX). After mixing is complete, the mixture is passed into a vacuum chamber and cured at 135° F. (57° C.) with T-12 catalyst.

The mechanical properties of the resulting polymerized propellant, presented in Table F below, show that good properties are retained over a wide temperature range.

TABLE F

Mechanical Properties of Propellant Using DETA/XIII-Coated RDX

| Temperature | Tensile Strength $s_m$, psi | Elongation $e_m$, % | Modulus $e_o$, psi |
|---|---|---|---|
| +140° F. | 62 | 70 | 135 |
| +77° F. | 114 | 72 | 219 |
| 0° F. | 187 | 61 | 473 |
| −40° F. | 313 | 58 | 854 |
| −65° F. | 625 | 48 | 2652 |

EXAMPLE 8

To a slurry of 20 m HMX particles in hexane (5.0 L) is added dropwise DETA (3 g) dissolved in acetone (60 mL) just prior to addition. When addition is complete, XIII diisocyanate (10 g) in acetone (60 g) is added and the mixture is stirred for an additional 3 minutes. Dinitrosalicylic acid (1N; 10 mL) is added, with stirring, after which the solvent is removed and the particles are dried.

What is claimed is:

1. A coating composition comprising a copolymer of a primary or secondary amine and 3-nitrazapentane diisocyanate.

2. A coating composition according to claim 1 wherein the amine is diethylenetriamine.

3. A coating composition according to claim 1 wherein the molar ratio of amine to diisocyanate is from about 1:1 to about 1:2.

4. A coating composition according to claim 2 wherein the molar ratio of amine to diisocyanate is from about 1:1 to about 1:2.

5. A coating composition according to claim 2 wherein the molar ratio of amine to diisocyanate is from about 1:1 to about 1:1.2.

6. A coated filler particle for solid propulsion propellants which comprises a filler particle coated with a copolymer comprising a primary or secondary amine and 3-nitrazapentane diisocyanate.

7. A coated filler particle according to claim 6 wherein the amine is diethylenetriamine.

8. A coated filler particle according to claim 6 wherein the molar ratio of amine to diisocyanate is from about 1:1 to about 1:2.

9. A coated filler particle according to claim 7 wherein the molar ratio of amine to diisocyanate is from about 1:1 to about 1:2.

10. A coated filler particle according to claim 7 wherein the molar ratio of amine to diisocyanate is from about 1:1 to about 1:1.2.

11. A coated filler particle according to claim 6 wherein the particle is a nitramine.

12. A coated filler particle according to claim 11 wherein the particle is cyclotetramethylene tetranitramine (HMX) or cyclo-1,3,5-trimethylene-2,4,6-trinitramine (RDX).

13. A coated filler particle according to claim 6 wherein the proportion of copolymer to filler particle is from about 0.2% to about 2.0%.

14. A solid propulsion propellant system which comprises an explosive component, filler particles and a binder or binder composition, wherein at least a portion of the filler particles are coated with a copolymer comprising a primary or secondary amine and 3-nitrazapentane diisocyanate.

15. A propellant system according to claim 14 wherein the propellant is nitro- or nitratoester plasticized.

16. A propellant system according to claim 14 wherein the amine is diethylenetriamine.

17. A propellant system according to claim 14 wherein the molar ratio of amine to diisocyanate is from about 1:1 to about 1:2.

18. A propellant system according to claim 16 wherein the molar ratio of amine to diisocyanate is from about 1:1 to about 1:2.

19. A propellant system according to claim 16 wherein the molar ratio of amine to diisocyanate is from about 1:1 to about 1:1.2.

20. A propellant system according to claim 14 wherein the proportion of copolymer to coated filler particle is from 0.2% to 2.0%.

21. A propellant system according to claim 14 wherein the coated filler particle is a nitramine.

22. A propellant system according to claim 21 wherein the coated filler particle is cyclotetramethylene tetranitramine (HMX) or cyclo-1,3,5-trimethylene-2,4,6-trinitramine (RDX).

23. A propellant system according to claim 14 wherein the proportion of coated filler particles in the system is from about 10% to about 75%, by weight.

24. A propellant system according to claim 14 wherein the proportion of coated filler particles in the system is from about 12% to about 50%, by weight.

25. A method for enhancing the bond between powdered solids and binder material in a solid propellant system, which method comprises mixing together filler particles, an explosive component and a binder or binder composition, and curing the propellant system in the presence of a catalyst, wherein at least a portion of the filler particles are coated with a copolymer comprising a primary or secondary amine and 3-nitrazapentane diisocyanate.

26. A method according to claim 25 wherein the propellant is nitro- or nitratoester plasticized.

27. A method according to claim 25 wherein the amine is diethylenetriamine.

28. A method according to claim 25 wherein the molar ratio of amine to diisocyanate is from about 1:1 to about 1:2.

29. A method according to claim 27 wherein the molar ratio of amine to diisocyanate is from about 1:1 to about 1:2.

30. A method according to claim 27 wherein the molar ratio of amine to diisocyanate is from about 1:1 to about 1:1.2.

31. A method according to claim 25 wherein the proportion of copolymer to coated filler particles is from about 0.2% to about 2.0%.

32. A method according to claim 25 wherein the coated filler particle is a nitramine.

33. A method according to claim 32 wherein the filler particle is cyclotetramethylene tetranitramine (HMX) or cyclo-1,3,5-trimethylene-2,4,6-trinitramine (RDX).

* * * * *